US005125187A

United States Patent [19]

Thiem

[11] Patent Number: 5,125,187

[45] Date of Patent: Jun. 30, 1992

[54] MOUNTED NON-DIRECTIONAL ROTOR FINISHING DEVICE

[76] Inventor: Eugene G. Thiem, P.O. Box 8439, Hobe Sound, Fla. 33455

[21] Appl. No.: 578,338

[22] Filed: Sep. 6, 1990

[51] Int. Cl.[5] ..... B24B 7/00

[52] U.S. Cl. ..... 51/111 R; 51/118; 51/179; 51/259; 51/281 SF; 51/134.5 R

[58] Field of Search ..... 51/111 R, 126, 117, 51/118, 259, 251, 281 SF, 179, 134.5 R

[56] References Cited

U.S. PATENT DOCUMENTS

| | | | |
|---|---|---|---|
| 3,456,401 | 7/1969 | Kushmok | 51/259 |
| 3,500,589 | 3/1979 | Ellege . | |
| 3,619,952 | 11/1971 | Leming et al. | 51/117 |
| 4,256,078 | 3/1981 | Whitty | 51/5 B |
| 4,361,988 | 12/1982 | Gramlich | 51/281 SF |

*Primary Examiner*—M. Rachuba
*Attorney, Agent, or Firm*—Hedman, Gibson & Costigan

[57] ABSTRACT

A device for creating a non-directional finish on a rotor mounted and spinning on a rotor lathe which is transformable from an operating position to a stowed position. The device comprises a U-shaped member with finishing surfaces on the side members of the U-shaped member to allow finishing of both sides of the rotor in one step and means to rotate the finishing surfaces. The means to rotate the finishing surfaces includes drive means, such as a drive roller, associated with a drive shaft. The drive shaft turns drive belts engaging the drive shaft at one end and disc axles associated with the finishing surfaces at the other end to rotate the finishing surfaces across the direction of the friction surfaces of the spinning rotor.

20 Claims, 3 Drawing Sheets

MOUNTED NON-DIRECTIONAL ROTOR FINISHING DEVICE

REFERENCE TO RELATED APPLICATION

The present application is related to the patent application entitled HAND HELD NON-DIRECTIONAL DISC BRAKE ROTOR FINISHING DEVICE, BY Eugene G. Thiem, filed Aug. 10, 1990 and incorporated herein by reference.

FIELD OF THE INVENTION

The present invention relates to a non-directional rotor finishing device for finishing machined rotors, especially disc brake rotors used on automobiles, trucks, motorcycles, etc.

BACKGROUND OF THE INVENTION

When repairing disc brakes and replacing brake pads it is generally preferred to cut the brake surface of the brake rotor to true the rotor and create a smooth finish free of scratches and grooves to improve braking efficiency. The brake or friction surface is normally cut by placing the rotor on a brake rotor lathe, which turns the rotor at high speeds, and running a cutting tool across the friction surface of the rotor to make an even cut with very close tolerances.

After the friction surface of the rotor is cut, it is desirable to create a finish on the surface to improve friction between the brake pad and the friction surface. Generally, the desired finish is created on the friction surface by hand sanding the surface with a fine or medium grit sand or emery paper or using a mechanical sander about the friction surface. The procedure must be carried out on each side of the rotor separately.

An example of a mechanical grinder that is mounted on a lathe for grinding rotor surfaces is shown in U.S. Pat. No. 3,500,589 to Ellege. The device is fixedly mounted to the lathe on the tool carriage and includes a base and a support bar on which the grinding tool is mounted. The Ellege device requires manual movement of the support bar on which the grinding tool is mounted from one side of the base to the other to grind both sides of a rotor. Also, engagement of the grinding disc with the surfaces requires movement of the entire tool carriage.

The current methods require additional time-consuming, manual steps to create a finish on the rotor friction surfaces. Therefore, it is an object of the present invention to create a quick and efficient non-directional finish on the friction surfaces on each side of a rotor while the rotor is still on the rotor lathe.

It is a further object of this invention to provide such a finish with a device that will operate either with or without an external power source.

It is yet another object of the present invention to provide a device for creating a non-directional finish on a brake rotor which attaches to the rotor lathe, folds out of the way of the user for storage during cutting of the rotor and unfolds into position for finishing the friction surfaces before the rotor is removed from the lathe.

It is another object of the invention to provide a rotor finishing device with replaceable finishing surfaces that needs minimal maintenance.

SUMMARY OF THE INVENTION

These and other objects are realized by a device for creating a non-directional finish on the friction surface of a rotor such as a disc brake rotor on a rotor lathe comprising a U-shaped member having side members, rotatable finishing surfaces on the side members, means to rotate the finishing surfaces, and means for mounting the device on the rotor lathe wherein when the means to rotate the finishing surfaces is engaged, the finishing discs rotate across the rotation of the friction surface of the rotor.

The means to rotate the finishing surfaces includes drive means comprising any means, most preferred being a non-external power source such as a drive roller between the side members of the U-shaped member, which engages the periphery of the rotor, associated with the rotatable finishing surfaces. Other means include external power sources such as motors, including air, electric, hydraulic and gas motors, which are associated with the finishing surfaces.

The means to rotate the finishing surfaces further preferably comprises a drive shaft placed between the side members of the U-shaped member cooperating with the drive means, drive axles associated with the finishing surfaces and drive belts between the drive shaft and the disc axles. This configuration allows the engagement of the drive means to rotate both finishing surfaces simultaneously.

The device is designed to be mounted permanently on the rotor lathe and requires no additional, unattached parts subject to loss or misplacement.

A non-directional finish of 25–50 microns is applied to the friction surfaces of the rotor by the rotating finishing surfaces on each of the side members of the U-shaped member.

BRIEF DESCRIPTION OF THE DRAWINGS

The present invention will be better understood when reviewed with the following drawings, in which like reference characters indicate like parts. These drawings, however, are for illustrative purposes only and are not intended to limit the invention in any manner whatsoever, wherein.

DETAILED DESCRIPTION OF THE PREFERRED EMBODIMENT

Figure 1:
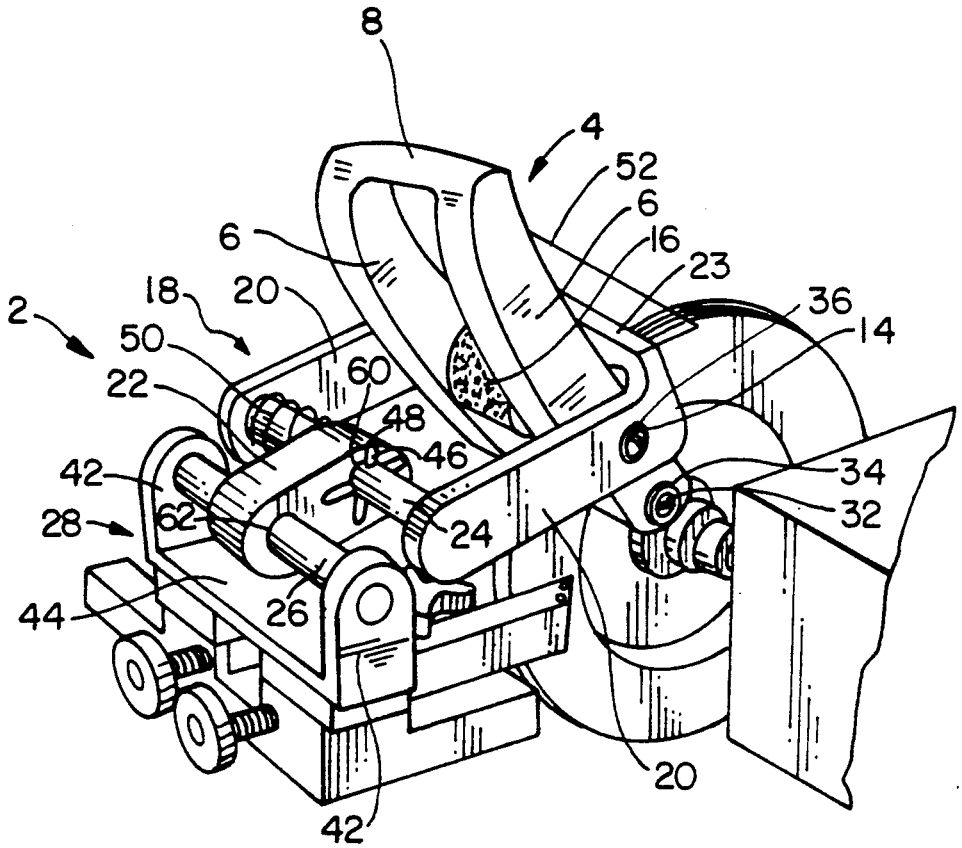
FIG. 1 is a perspective view of the right side of the present invention in its operating, working position, shown about a disc brake rotor on a rotor lathe.

As shown in the FIGURES the present invention comprises a rotor friction surface finishing device 2, for creating a non-directional finish on the friction surfaces on both sides of a rotor mounted on a rotor lathe. The device 2 comprises a U-shaped member 4 having side members 6 and a bottom member 8 which serves as handle means. Mounted on the internal faces 10 of the end members 6 are rotatable finishing discs 12. Between the side members 6 is a drive shaft 14 on which a drive roller 16 is mounted.

Figure 2:
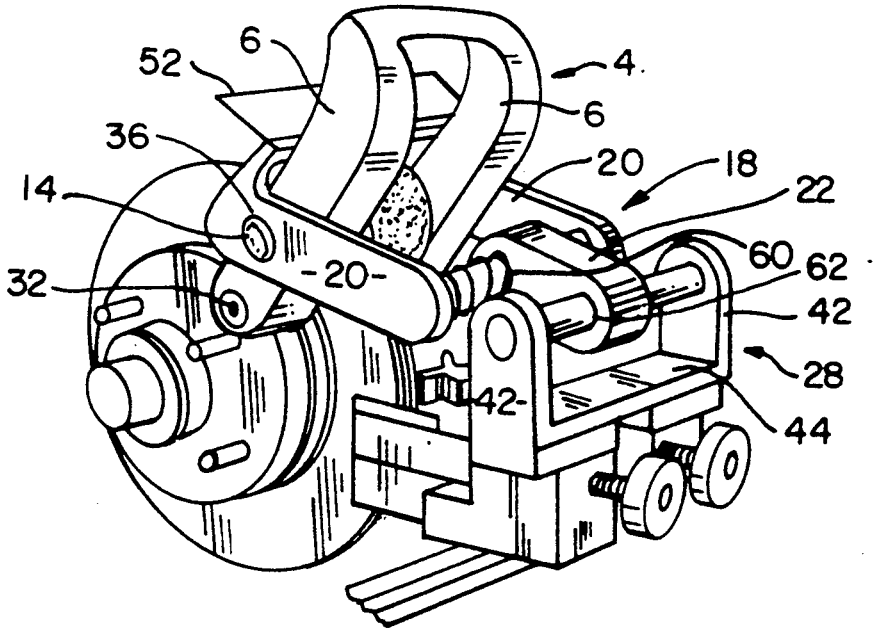
FIG. 2 is a perspective view of the left side of the present invention in its operating position.

Means for positioning the U-shaped member from a stowed position (shown in FIG. 3) to an operating position (shown in FIGS. 1 and 2) includes a hinge 22 and a support member 18, the arms 20 of said support member 18 allow movement of the U-shaped member 4 therebetween and includes means for pivotable attachment to the U-shaped member 4. The hinge 22 of the support member 18 has apertures 60 and 62 in the top and bottom which allow pivotable passage of a crossbar 24 of the support member 18 and a rod 26 of the mounting means 28 respectively. The rod 26 on which the support member 18 pivots is fixedly attached to mounting means 28 used to attach the device 2 to the rotor lathe. Locking means are also associated with the hinge 22 to secure the device 2 in the operating and stowed positions.

The U-shaped member 4, as stated above, has rotatable finishing discs 12 on the internal faces of the side members 6. The finishing discs 12 have placed thereon finishing surfaces 30, i.e. sanding pads or discs, generally of about 24 to about 36 grit. The finishing surfaces 30 of the discs 12 can be replaced by any suitable means such as hook and loop fasteners such as VELCRO, snaps, adhesive backings, etc. In the preferred embodiment, the finishing surfaces 30 are aluminum oxide sanding discs attached to the discs 12 by the use of adhesive between the discs 12 and the back of the aluminum oxide discs.

Figure 3:
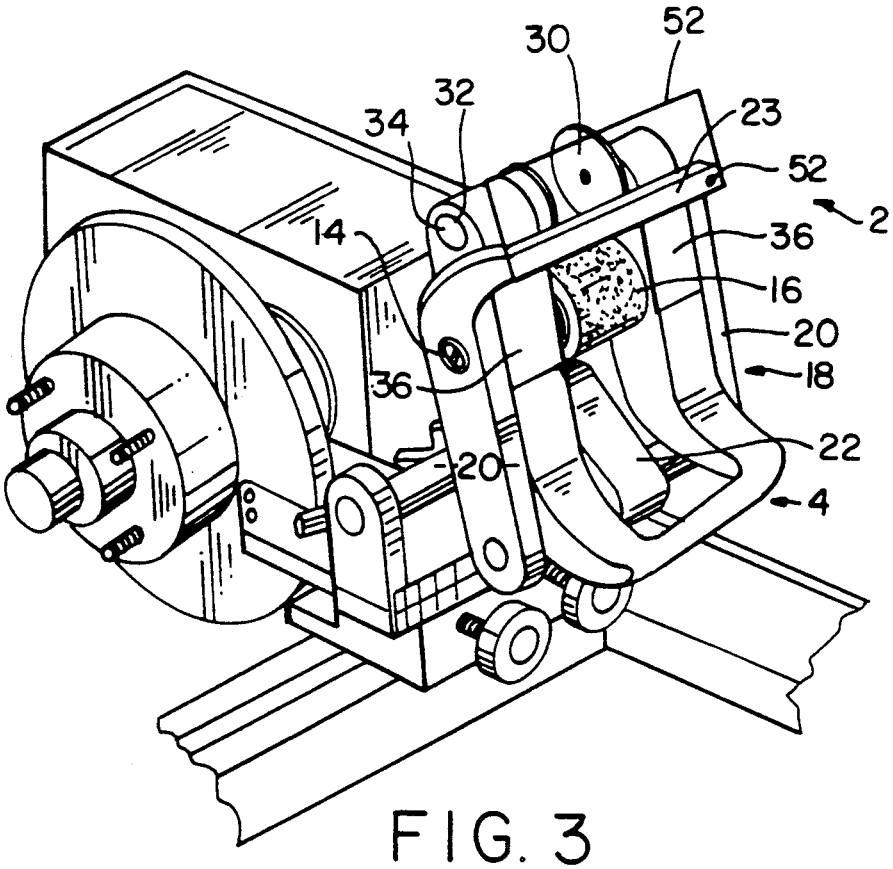
FIG. 3 is a perspective view of the invention in its stowed position.

As shown in FIG. 3, the finishing discs 12 are of different diameters. The disc 12*a* on the left side member 6 is of a smaller diameter (approximately 1½ inches) than the disc 12*b* on the right side member 6 (approximately 2 inches). This difference in size between the two finishing discs 12 is based on the positioning of a disc brake rotor on the rotor lathe wherein the rotor hub is shown mounted on the left side. Compare FIGS. 1 and 2. Placement of the smaller disc 12*a* on the right side member 6 is preferred, by reversing the finishing disc placement (i.e. 12*a* on the right and 12*b* on the left), when the rotor is mounted with the rotor hub on the right side.

Rotation of the finishing discs 12 is achieved by permanent attachment of each of the discs 12 to disc axles 32 which pass through the end of the side members 6 and ride on bearings internal to the side members 6. The disc axles 32 can be made of any suitable material, , but are preferably made of steel or aluminum and are about ¼ to about 5/16 inch in diameter. The bearings 33 on which the disc axles 32 ride can be pin bearings or ball bearings of any suitable size with sealed ball bearings being preferred.

The ends of the disc axles 32 opposite the finishing discs 12 are threaded to accept a securing nut which holds the disc axles 32 in place. A recess 34 in each of the external faces of the side members 6 allows access to the threaded ends of the disc axles 32 and the securing nuts (not shown) placed thereon The length of the drive axles 32, and securing nuts placed thereon, are of a predetermined length so that when the device 2 is in its operating configuration the threaded ends of the drive axles 32 do not extend substantially beyond the external faces of the side members 6. The recess 34 is, likewise, of sufficient depth to assure that the securing nuts do not extend substantially beyond the external faces of the side members 6. Covers (not shown) are preferably placed over the threaded ends of the axles 32 and securing nuts to avoid injury from the rotating axles 32 and nuts placed thereon.

Between the side members 6 of the U-shaped member 4 at the ends farthest from the finishing discs 12 is located a rigid structural bottom member 8 which serves as handle means The handle means 8 is approximately ¾ to 1 inch in diameter and is preferably made of a steel or aluminum rod, immovably fixed between the side members 6 for structural support. The handle means 8 is used to pivot the U-shaped member 4 across the rotor friction surfaces.

A rotatable drive shaft 14 is located intermediate the finishing discs 12 and the handle means 8. A drive roller 16 made of hard rubber, or preferably polyurethane, and approximately 1.75 to 2.50 inches in diameter, is fixedly mounted on the drive shaft 14. The roller 16 is mounted on the shaft 14 by key means or set screws (not shown) which mount flush with the exterior of the drive roller 16 and engage the drive shaft 14. The rotatable drive shaft 14 is approximately ¾ to 1¼ inches in diameter and is preferably made of steel or aluminum or a material with like physical properties. Rotation of the drive shaft 14 is enhanced wherein the shaft 14 rides on sealed ball bearings 17 or pin bearings in the side members 6.

The top or bottom faces of the side members 6 have covers 36 which are preferably attached by six small screws around the perimeter of each cover 36 (removable top covers 36 shown). Removal of each of the covers 36 reveals a cavity 40 in each side member 6 in which a drive belt 38 runs between the drive shaft 14 and the disc axel 32. See FIG. 4.

The drive belt 38 is preferably a toothed timing belt. A toothed timing belt pulley 39 associated with the toothed timing belt 38 is fixedly attached to each of the disc axels 32 and to each side of the drive shaft 14 within the cavities 40.

In its preferred embodiment the device 2 requires no external power source. The power to run the device 2 is provided by the rotation of the rotor on the rotor lathe itself. To operate the device 2 when the rotor is spinning on the rotor lathe, the drive roller 16 is placed in contact with the periphery of the spinning rotor. The rotation of the rotor is translated to rotation of the drive roller 16, and hence the drive shaft 14, thereby turning the toothed timing belt 38 associated with the toothed timing pulleys 39 on each side the drive shaft 14. The toothed timing belt 38 in turn rotates the toothed timing pulleys 39 on the disc axels 32, thereby rotating the finishing discs 12 with finishing surfaces 30 attached thereto.

Alternatively, in place of the drive roller 16 an external power source, such as an air, electric or hydraulic motor, etc., can be used to rotate the finishing surfaces 30. The motor (not shown) would be placed between the side members 6 of the U-shaped member 4 and would cooperate with the drive shaft 14 to rotate the drive shaft 14, belts 38 and disc axles 32. The use of such an external power source, however, may require moving the drive shaft 14 farther back on the side member 6, and the use of longer belts 38, so that the power source does not interfere with the spinning rotor.

Preferred alignment of the drive roller 16 on the spinning brake rotor includes contact of the drive roller 16 on the spinning rotor at about between 35° and 60° from top dead center, i.e 35°–60° from the highest point of the spinning rotor. Proper alignment of the device 2 on the spinning rotor is achieved through the use of means for positioning the U-shaped member 4. The means for positioning allows the U-shaped member 4 to be moved from a stowed position, shown in FIG. 3, to an operating position, shown in FIGS. 1 and 2.

The means for positioning the U-shaped member 4, as stated above, comprises a support member 18 having parallel arms 20, a fixed, rigid crossbar 24 at the bottom of said arms 20, means for engaging the U-shaped member 4 on the sides of said arms 20, a stop bar 23 at the top of said arms 20 and a hinge 22, which pivotably engages the crossbar 24 at one end and the mounting means 28 at the other end. The stop bar 23 may have attached a clear safety shield 52 to deflect flying debris, attached by retaining screws 54.

Figure 4:
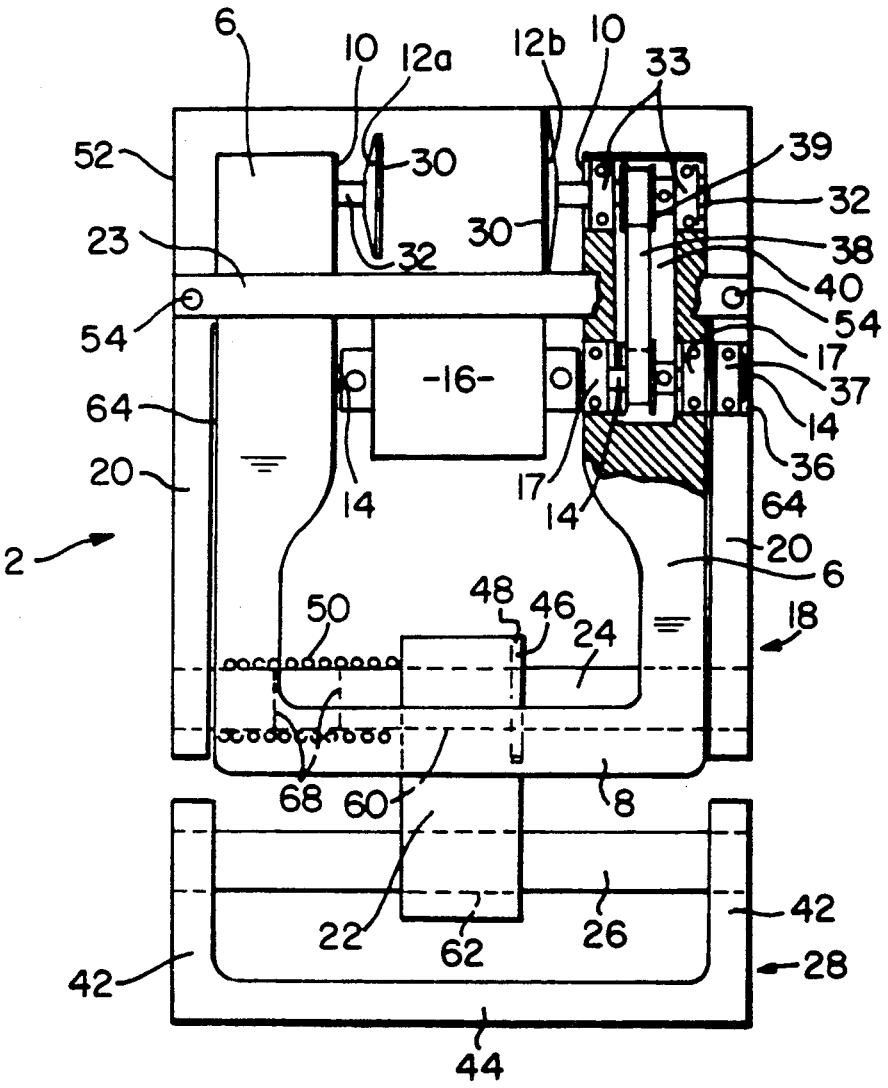
FIG. 4 is a top plan view of the invention in partial cross section.

Between the internal faces of the parallel arms 20 of the support member 18 and the external faces of the sides 6 of the U-shaped member 4 on the drive shaft 14 are placed nylon washers 64 having a thickness of 0.031 inches (See FIG. 4). This allows freedom of movement of the U-shaped member 4 between the arms 20 of the support member 18 while providing structural stability.

Means to engage the U-shaped member 4 on the sides of the arms 20 of the support member 18 comprise apertures 36 at the top of the arms 20 of the support member 18 through which the drive shaft 14 extends from the U-shaped member 4. At least one of the ends of the drive shaft 14 is threaded and, once placed through the sides 6 of the U-shaped member 4 and the arms 20 of the support member 18, have a nut 41 placed over the threaded portion to hold the drive shaft 14 securely in place. As stated above, a nylon washer 64 is placed on the drive shaft 14 between the sides of the U-shaped member 4 and the arms 20 of the support member 18.

Within the arms 20 of the support member 18, around the apertures 36, are sealed bearings 37 to allow rotation of the drive shaft 14 therein. The apertures 36 in the arms 20 have recesses at the outer ends which are deep enough to substantially contain the ends of the drive shaft 14, and nuts (not shown) thereon, and are wide enough to allow access to the nuts on the ends of the drive shaft 14 by a wrench, etc. for removal and replacement. Covers (not shown) engaging the sides of the apertures 36 may be used over the apertures 36 to shield the ends of the drive shaft 14, and nuts thereon, as a safety means when the device 2 is engaged.

Attachment of the U-shaped member 4 to the support member 18 along the drive shaft 14 allows tilting of the U-shaped member 4 about the axis of the drive shaft 14. This permits the rotating finishing discs 12 to be moved across the friction surface of the rotor in a sweeping motion while maintaining contact between the drive roller 16 and rotor periphery. The handle means 8 of the U-shaped member 4 is used by the operator to move the discs 12 across the friction surfaces of the rotor in a sweeping motion.

As set forth above, the hinge 22 of the support member 18 has an aperture 60 at the top through which the crossbar 24 passes and an aperture 62 at the bottom through which a fixed rod 26 of the mounting means 28 passes. The apertures 60 and 62 in the hinge 22 pivot about the crossbar 24 and the rod 26, respectively, to allow movement of the device 2 from a stowed to an operating position.

As best shown in FIG. 3, when the device 2 is in its stowed position the hinge 22 is directed toward the user with the crossbar 24 of the support member 18 below and in front of the rod 26 of the mounting means 28. The arms 20 of the support member 18 are in an almost vertical position, as are the sides 6 of the U-shaped member 4. In this stowed position the user can cut the friction surfaces of the rotor on the rotor lathe without interference from the finishing device 2.

To operate the device 2 the user need merely back off the lathe cutter bits, move the cutter head back and push against the support member 18 on the side with the spring 50 to unlock a locking pin 46 on the crossbar 24 which engages a recess 48*a* in the hinge 22. The user then pulls the device 2 upward by the handle means 8 of the U-shaped member 4. This rotates the hinge 22 about rod 26 until the hinge 22 is directed away from the user and toward the rotor to where the locking pin 46 engages the operating recess 48*b*.

A spring 50 is placed between the hinge 22 and the arm 20 of the support member 18 to hold the locking pin 46 in the recesses 48 Nylon shoulder bushings 68, $\frac{3}{4}\times\frac{3}{4}$ I.D., are used on the ends of the spring 50, contacting the hinge 22 and the arm 20 to provide the spring 50 with freedom of movement.

When the hinge 22 of the support member 18 moves into the operating or stowed position the pin 46 automatically engages the recess 48 to lock the device 2 in the desired position. The crossbar 26 then rotates in aperture 62 until the drive roller 16 contacts the periphery of the rotor.

The U-shaped member 4 moves laterally from left to right to allow contact between the finishing surfaces 30 with the respective friction surfaces of the rotor. Lateral movement is provided by sliding the hinge 22 along the rod 26 through aperture 62 which is only slightly larger than rod 26.

The mounting means 28 holds the device 2 fixed on the lathe during movement from a stowed to an operating position and during use or operation of the device 2. The rod 26 of the mounting means 28 is preferably made of a $\frac{3}{4}$ to 1 inch steel or aluminum rod, is held fixed by vertical side members 42 fixedly attached to a horizontal member 44 which bolts or is clamped to the lathe itself for permanent, or semi-permanent, mounting of the device 2.

When the device 2 is mounted and in its operating position, with the drive roller 16 engaging the spinning rotor, a non-directional finish of 25–50 microns is placed on each of the rotor friction surfaces in four simple steps. First, the user slides the support member 18, including the U-shaped member 4, along the rod 26, about the aperture 62 in the hinge 22, to either the left or right to firmly contact the finishing surface 30 against that side of the rotor. Next, in a sweeping motion, the user moves the handle means 8 of the U-shaped member 4 up and down, pivoting the U-shaped member 4 around the axis of the drive shaft 14 between the arms 20 of the support member 18, thereby moving the finishing surface 30 across the rotor friction surface. The hinge 22 of the support member 18 is then slid on rod 62 to the other side to allow contact between the other finishing surface 30 and the friction surface on the other side of the rotor. Finally, with a similar sweeping motion with the handle means 8, the finishing surface 30 is moved across the other brake surface. The device 2 can then be moved into its stowed position by pushing against the arm 20 of the support member 18 with the spring 50 to compress the spring 50 and release the locking pin 46 from the recess 48. The support member 18 can then be pivoted into its stowed position.

Should the drive roller 16 ever need replacement, the covers 36 on the side members 6 are removed and two set screws (not shown) in the rear toothed pulley 39 are loosened, but not removed, to where the drive shaft 14 can be slid out and the drive roller 16 replaced. Replacement of a drive belt 38 is as above, however, the drive shaft 14 is only slid out to the point where the toothed pulley 39 can be removed. Also, at the other end of the cavity 40, the nut on the disc axle 32 is removed and two set screws (not shown) on the other toothed pulley 39 are loosened. The disc axle 32 is then also slid out so the toothed pulley 39 thereon can be removed. A new belt 38 is then put in place and the procedure reversed. LOCKTITE #222 should be placed on all small screws and upon drive shaft nuts and disc axle nuts upon replacement.

All parts of the device 2 are made of steel, aluminum or glass filled engineered resin or like material except the finishing surfaces 30, the drive roller 16, the bearings, the toothed timing belt 38 and the toothed timing pulleys 39.

The finishing device 2 requires no lubrication and no maintenance other than occasional cleaning with a brush or vaccuum and occasional replacement of the finishing surfaces 30. The abrasive nature of the cast iron chips and dust associated with machining and finishing disc rotors may require an occasional thorough cleaning of the means for positioning the device, including the apertures 60 and 62 of the hinge 22 and the crossbar 24 and rod 26.

I claim:

1. A device for creating a non-directional finish on the friction surface on a disc brake rotor spinning on a rotor lathe comprising a U-shaped member having side members, rotatable finishing surfaces on the side members and means to rotate the finishing surfaces comprising drive means taken from the group comprising a motor and a drive roller which is engaged by the spinning rotor and further comprising a drive shaft which extends across the side members of the U-shaped member and cooperates with the drive means, a disc axle associated with each finishing surface and a drive belt associated with each disc axle engaging said drive shaft at one end and the respective disc axle at the other end, said device further comprising support means to support the U-shaped member and means for mounting the device on the rotor lathe, wherein when the means to rotate the finishing surfaces is engaged, the finishing surfaces rotate across the rotation of the friction surface on the rotor.

2. The device of claim 1 further comprising toothed timing pulleys attached to the drive shaft and a toothed timing pulley attached to each of said disc axles wherein the drive belts are toothed timing belts which engage the toothed timing pulleys attached to the drive shaft at one end and the toothed timing pulleys of the disc axles at the other end to rotate the finishing surfaces.

3. The device of claim 1 wherein the drive belt and the portions of the drive shaft and disc axles which cooperate with the drive belt are located within cavities in the side members of the U-shaped member.

4. The device of claim 3 wherein the cavities are sealed with removable covers.

5. The device of claim 1 wherein the disc axles engaging the rotatable finishing surfaces pass through apertures in the side members and terminate on the side opposite the finishing surfaces with a threaded section on which a nut is placed to removably hold the disc axle, and finishing surface, securely.

6. The device of claim 5 further comprising a recess on the side members in which the nut sits and from which the threaded section of the drive shaft or nut does not substantially extend.

7. The device of claim 1 wherein the disc axles and the drive shaft rotate on bearings within the side members of the U-shaped member.

8. The device of claim 1 further comprising means for positioning the device from a stowed position to an operating position.

9. The device of claim 8 wherein the means for positioning the device comprises a support member having parallel arms, said arms being held in place by a rigid cylindrical crossbar, a hinge member, said hinge member having means for pivotably engaging the crossbar at the top and pivotally engaging the means for mounting the device at the bottom, and means for pivotably engaging the U-shaped member.

10. The device of claim 9 wherein the arms of the support member are slightly wider than the side members of the U-shaped member to allow the U-shaped member to pivot within the support member.

11. The device of claim 9 wherein the means for pivotably engaging the U-shaped member comprises an extended drive shaft wherein said drive shaft passes through apertures in the side members of the U-shaped member and apertures in the arms of the support member and further comprising a thin washer between the side members of the U-shaped member and arms of the support member to further facilitate pivoting of the U-shaped member within the arms of the support member.

12. The device of claim 11 further comprising threads on at least one end of the drive shaft, accessible within a recess in the arm of the support member, and engaged by a nut to removably and securely retain the drive shaft.

13. The device of claim 12 wherein the drive shaft rotates on bearings in the side members of the U-shaped member and in the arms of the support member.

14. The device of claim 9 further comprising a locking pin on the cylindrical crossbar which cooperates with one or more recesses in the hinge to releasably prohibit movement of the device when in the stowed and/or operating positions, and a spring to ensure engagement of the locking pin and the recess.

15. The device of claim 9 further comprising means for right to left lateral movement of the support member when in the operating position.

16. The device of claim 1 wherein the mounting means comprises a horizontal member including means to securely attach the horizontal member to the lathe, vertical members securely attached to each end of the horizontal member and a cylindrical rod member rigidly fixed between said vertical members.

17. The device of claim 9 wherein the means for lateral movement comprises sliding means between the rod of the mounting means and the hinge.

18. The device of claim 1 for use with a disc brake rotor wherein the finishing surface relating to the side of the brake rotor having a hub is of a smaller diameter than the finishing surface relating to the side of the rotor without the hub.

19. The device of claim 1 wherein the finishing surfaces are replaceable sanding discs removably placed on substantially rigid finishing discs with diameters conforming substantially to the diameters of the finishing discs on which they are placed.

20. A method of creating a non-directional finish on the friction surfaces of a rotor on a rotor lathe, using a finishing device comprising a U-shaped member, having side members rotatable finishing surfaces on the side members, a drive roller between said side members, means to rotate the finishing discs associated with the drive roller, support means and means for mounting the device on the rotor lathe comprising engaging the drive roller on the periphery of the spinning rotor, contacting the finishing surface with the friction surface of the brake rotor on the side adjacent to that finishing surface, tilting the U-shaped member by handle means so the rotating finishing surface moves across the friction surface until the desired finish is achieved, contacting the other friction surface with the finishing surface on the other side of the rotor and tilting the U-shaped member so the rotating finishing surface moves across the friction surface of the rotor until the desired finish is achieved.

* * * * *